US006896644B1

(12) United States Patent
Voigt

(10) Patent No.: US 6,896,644 B1
(45) Date of Patent: May 24, 2005

(54) WEIGHT STAND FOR FREE WEIGHTS

(76) Inventor: Werner W. Voigt, 1421 N. Matlock, Mesa, AZ (US) 85203

( * ) Notice: Subject to any disclaimer, the term of this patent is extended or adjusted under 35 U.S.C. 154(b) by 505 days.

(21) Appl. No.: 10/174,763

(22) Filed: Jun. 18, 2002

(51) Int. Cl.[7] ..... A63B 21/078

(52) U.S. Cl. ..... 482/104; 482/106; 482/108; 248/300

(58) Field of Search ..... 482/38, 93, 94, 482/104, 106, 108, 138, 142, 904; D21/679, D21/686, 690, 691; 248/214, 215, 300, 301, 248/322, 339, 340

(56) References Cited

U.S. PATENT DOCUMENTS

| | | | | |
|---|---|---|---|---|
| D184,508 | S * | 3/1959 | Burt | 248/300 |
| 3,874,657 | A * | 4/1975 | Niebojewski | 482/104 |
| 4,666,150 | A | 5/1987 | Segrist et al. | |
| D291,338 | S * | 8/1987 | Ringel et al. | D21/691 |
| 5,184,992 | A * | 2/1993 | Banks | 482/104 |
| 5,411,459 | A | 5/1995 | Hayden | |
| 5,433,687 | A * | 7/1995 | Hinzman et al. | 482/104 |
| 5,616,108 | A | 4/1997 | Hayden | |
| 5,669,859 | A * | 9/1997 | Liggett et al. | 482/94 |
| 5,725,460 | A | 3/1998 | Marsh | |
| 5,772,561 | A | 6/1998 | Hayden | |
| 5,924,964 | A | 7/1999 | Hayden | |
| 5,954,619 | A | 9/1999 | Petrone | |
| D415,223 | S | 10/1999 | Gay | |
| 5,971,898 | A | 10/1999 | Schoolfield | |
| 6,149,556 | A | 11/2000 | Jordan | |
| D441,813 | S * | 5/2001 | Ceppo | D21/686 |
| D443,660 | S * | 6/2001 | Ceppo | D21/686 |
| 6,715,728 | B2 * | 4/2004 | Nielsen | 248/339 |

FOREIGN PATENT DOCUMENTS

| | | | |
|---|---|---|---|
| DE | 3430475 | A1 * | 2/1986 |
| WO | WO 9836799 | A1 * | 8/1998 |

* cited by examiner

*Primary Examiner*—Justine R. Yu
*Assistant Examiner*—Victor K. Hwang
(74) *Attorney, Agent, or Firm*—Schmeiser Olsen & Watts, LLP

(57) ABSTRACT

A weight stand having a weight support that extends between opposing side frame members of a frame assembly is disclosed. The opposing side frame members are provided with a series of pegs adapted to maintain the weight support at various heights. The space between the opposing side frame members is suitable for placement of a weight bench, and also is sufficient to admit a person acting as a spotter. The weight support, in at least one embodiment, includes upper and lower support pieces arranged at an angle to each other so as to form a wedge-shaped area in which dumbbells can securely rest. The configuration of the weight support is such that dumbbells can readily be retrieved and replaced.

11 Claims, 2 Drawing Sheets

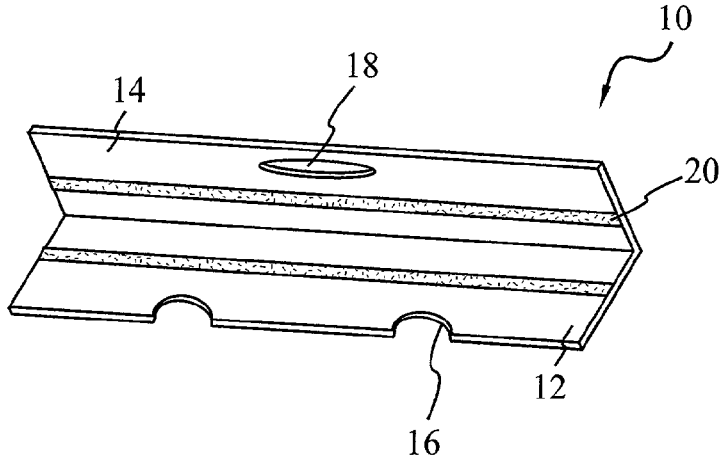
FIG. 1
FIG. 2
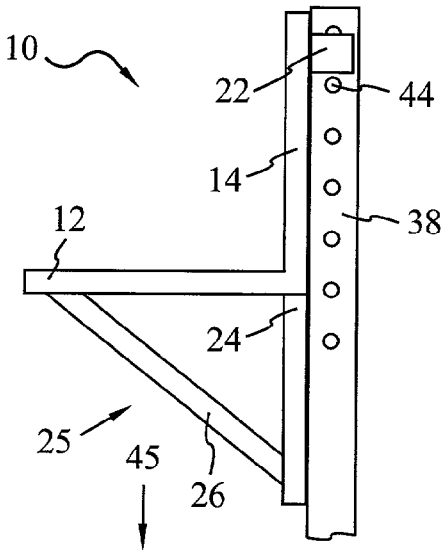
FIG. 3
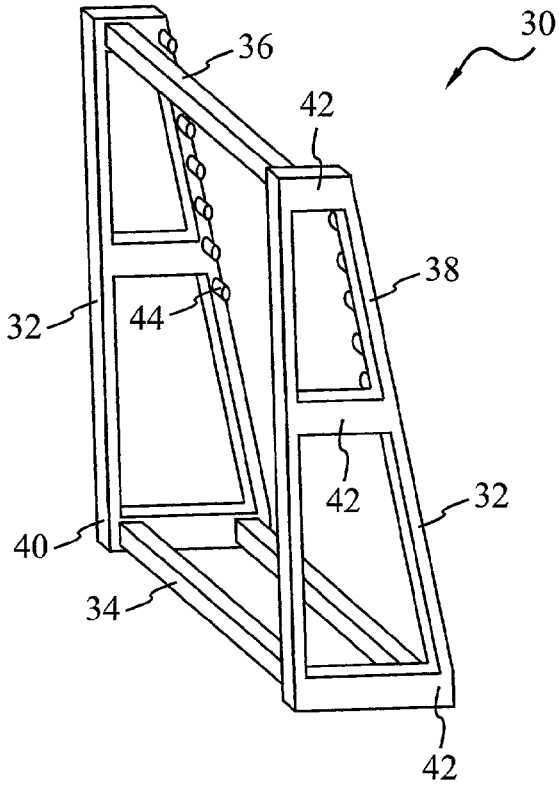
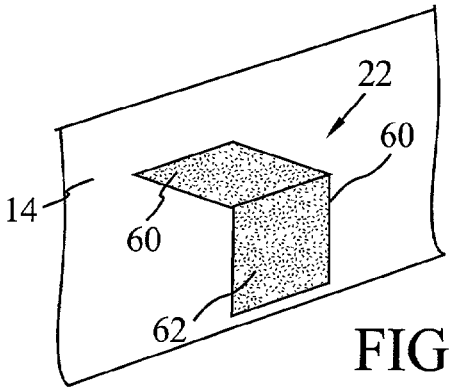
FIG. 2A

WEIGHT STAND FOR FREE WEIGHTS

BACKGROUND OF THE INVENTION

1. Technical Field

This invention generally relates to weightlifting apparatus, and more specifically relates to a weight stand for free weights.

2. Background Art

A conventional gym or other weightlifting facility may contain both weight machines and free weights, both of which are widely used for weight training purposes. Weight machines are characterized by weight stacks constrained to travel back and forth along a track. In general, weightlifters do not directly manipulate, or have direct contact with, the weights of a weight machine, instead contacting bars or plates that are connected by pulleys and cables to the weight stacks. Weight machines offer built-in stability, as well as a certain measure of safety, but they lack the flexibility, freedom, and range available with free weights, so called because they are not constrained in their movement to a single plane or track as weights on a weight machine are. Rather, they are free to be moved through the entire range of motion of which the weightlifter is capable.

Free weights include barbells and dumbbells, and generally comprise one or more pairs of weighted disks, plates, spheres, or the like attached in balanced fashion to a bar that is directly grasped by a user. The word "dumbbell" is conventionally used, and will be used herein, to refer to a free weight having a relatively short bar designed to be grasped with one hand and lifted with one arm alone. (Barbells generally have longer bars meant to be lifted with both arms.) There exist various devices intended to assist weightlifters with the use of dumbbells. Some of these provide a way to select the position at which the dumbbells are presented to the weightlifter at the beginning of an exercise and stored after an exercise set is completed. This positioning is important for reasons of stability, safety, and efficiency, among other reasons. Some exercises, for example, are performed with the dumbbells in the region of the torso and head. Getting the dumbbells to that position requires energy to be expended. If an exercise set is begun immediately after raising the dumbbells into position, the energy expended will not be available for that exercise set. Similarly, after the completion of an exercise set the muscles worked will be fatigued, and less able to carefully manipulate the dumbbells. Weight stands and the like provide a convenient place to set the weights when they're not in use that is easier and safer than dropping them to the floor.

Dumbbells lend themselves nicely to various types of lifting exercises, whether performed from a standing position, on a flat bench, on an inclined or declined bench, or from some other position. Different weightlifting positions, as well as different exercises, require the dumbbells to be presented to the weightlifter at various heights above the floor or weight bench. Existing weight stands are flawed in that they may not easily be adjusted from one height to another, and in that they do not provide secure support for multiple dumbbells while allowing the weights to be easily retrieved and replaced. This means that, among other drawbacks, existing weight stands cannot handle the various kinds of exercises one may wish to perform with free weights.

SUMMARY OF THE INVENTION

Therefore, there exists a need for a weight stand for free weights having an easily adjustable mechanism for presenting dumbbells to a weightlifter at various positions, thus being compatible with several different weight lifting exercises. The present invention fills that need by providing a weight stand having a weight support that extends between opposing side frame members of a frame assembly. The opposing side frame members are provided with a series of pegs adapted to maintain the weight support at various heights. The space between the opposing side frame members is suitable for placement of a weight bench, and also is sufficient to admit a person acting as a spotter. The weight support, in at least one embodiment, includes upper and lower support pieces arranged at an angle to each other so as to form a wedge-shaped area in which dumbbells can securely rest. The configuration of the weight support is such that dumbbells can readily be retrieved and replaced.

The frame assembly may include top and bottom frame members attached to the opposing side frame members to lend stability to the entire structure. Identification numbers may be placed next to each peg in order to help a weightlifter remember personally-preferred, exercise-specific positions for the weight support. The weight support may be adjusted by removing it from one set of pegs and replacing it on a different set. For example, in an embodiment of the invention where the weight support includes receptacles adapted to rest on the pegs, the weight support may be adjusted simply by lifting it off of one set of pegs and placing the receptacles over another set of pegs. The weight support may be provided with an impact strip to cushion the dumbbells, wrist cutouts to ease access to the weights, a carrying slot, reinforcing extensions, and other performance-enhancing features.

BRIEF DESCRIPTION OF THE DRAWINGS

The foregoing and other features and advantages of the invention will be apparent from the following more particular description of specific embodiments of the invention, as illustrated in the accompanying drawings, wherein:

FIG. 1 is a perspective view of a weight support configured according to an embodiment of the present invention;

FIG. 2 is a side view of a weight support configured according to another embodiment of the present invention;

FIG. 2A is a perspective view of a weight support receptacle configured according to an embodiment of the present invention;

FIG. 3 is a side view of a side frame member configured according to an embodiment of the present invention.

It should be noted that the figures are not necessarily drawn to scale, and that elements having similar functions may in some cases be labeled using the same reference numerals.

DETAILED DESCRIPTION OF EMBODIMENTS OF THE INVENTION

Figure 4:
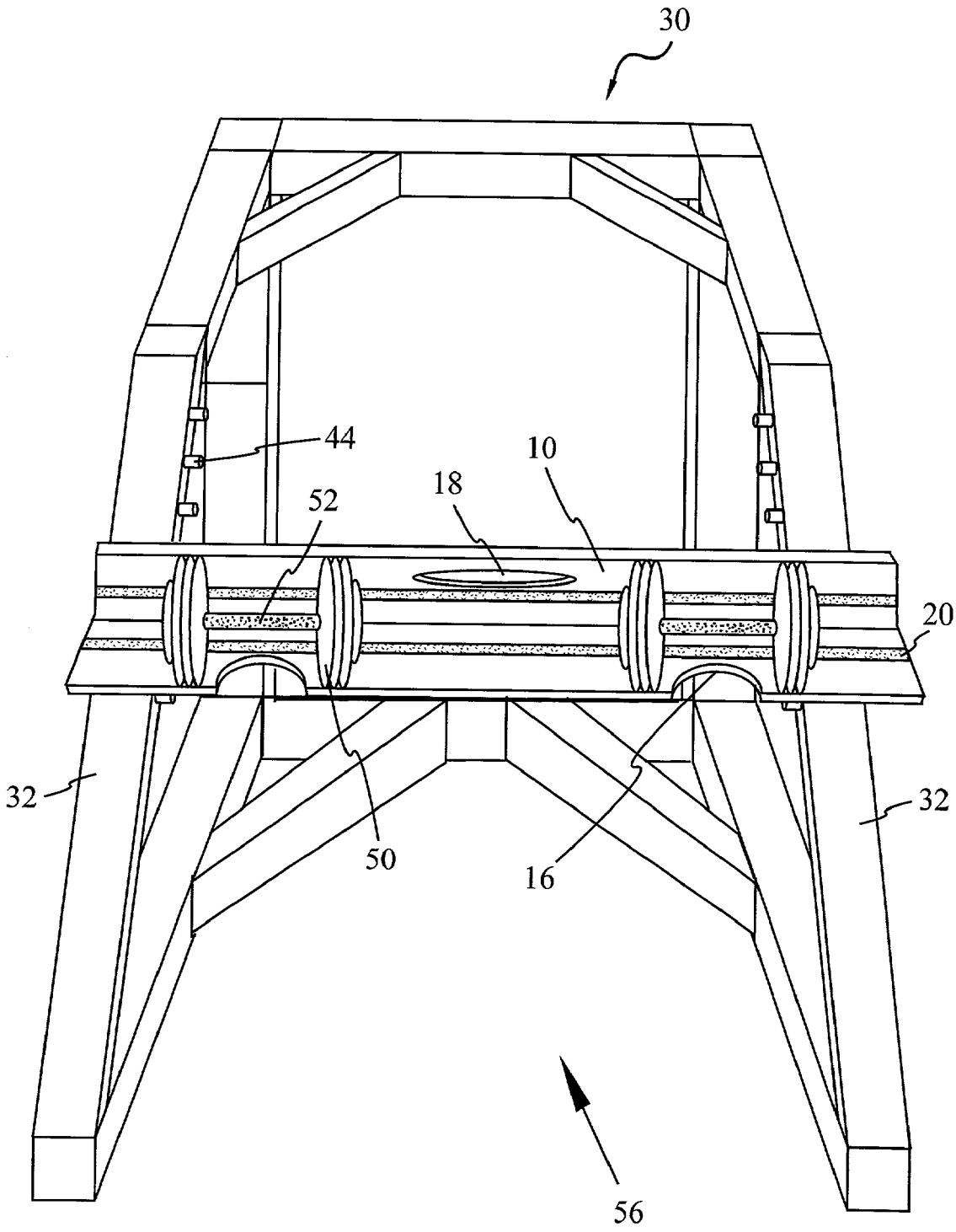
FIG. 4 is a front perspective view of a weight stand with a weight support configured according to an embodiment of the present invention.

As was first disclosed above, the present invention provides a weight stand having a weight support that extends between opposing side frame members of a frame assembly.

The opposing side frame members are provided with a series of pegs adapted to maintain the weight support at various heights. The space between the opposing side frame members is suitable for placement of a weight bench, and also is sufficient to admit a person acting as a spotter. The weight support, in at least one embodiment, includes upper and lower support pieces arranged at an angle to each other so as to form a wedge-shaped area in which dumbbells can securely rest. The configuration of the weight support is such that dumbbells can readily be retrieved and replaced.

Referring now to the figures, and in particular to FIG. 1, a weight support 10 comprises a lower support piece 12 attached at an angle to an upper support piece 14. In one embodiment, weight support 10 is constructed of three-quarter-inch aluminum, although other materials, such as steel, may also be suitable, as will be readily apparent to one of ordinary skill in the art. Weight support 10 is adapted to receive and support dumbbells, not shown in FIG. 1, or other free weights. Lower support piece 12 may include one or more cutouts 16 into which a weightlifter's wrists, forearms, or hands may be inserted in order to ease the access to the weights resting on weight support 10. Upper support piece 14 may include a carrying slot 18. A weightlifter may insert a hand into carrying slot 18 and transport, lift, carry, or otherwise manipulate weight support 10. Carrying slot 18 may be centered in upper support piece 14 so that weight support 10 will be balanced as it is being manipulated. Cutouts 16 and carrying slot 18 may be cut into weight support 10 using, for example, a computer-guided high-pressure water jet cutting tool, although many other cutting methods known in the art would also be suitable.

In one embodiment, either or both of lower support piece 12 and upper support piece 14 may be provided with an impact strip 20 that is adapted to cushion the weights resting on weight support 10 and to protect weight support 10 from damage or wear due to contact with the weights. Impact strip 20 also serves to reduce the noise created when weights are placed, sometimes forcefully, on weight support 10. A further benefit of impact strip 20 is that it may increase friction between the weights and weight support 10, thus reducing the chances a dumbbell or other free weight will slip off of or slide around on weight support 10. Impact strip 20 may be a length of rubber, plastic, cloth, or other cushioning material attached along the entire length or a portion of weight support 10. Upper and lower support pieces 12 and 14 may each be protected with a single, permanently-placed impact strip 20 (one for each support piece 12 and 14) because dumbbells of widely varying weight classifications will conventionally contact weight support 10 in the same general region. For example, a 30-pound dumbbell may comprise one pair of weight plates while a 150-pound dumbbell may comprise seven pairs of plates, yet all such plates will conventionally have substantially similar diameters, and will all contact weight support 10 in the area where impact strip 20 is placed. Impact strips having greater or lesser widths may also be used for weight plates of other diameters.

Referring now to FIGS. 2, 2A, and 3, a side view of an embodiment of weight support 10 is shown (FIG. 2) in which lower support piece 12 and upper support piece 14 are arranged at an angle of approximately 90 degrees with respect to each other. In other embodiments of the invention, lower and upper support pieces 12 and 14 may have other angular relationships, limited only by the need to support a free weight therebetween. A receptacle 22, used to position weight support 10 on a weight stand 30, is attached to upper support piece 14. The attachment may be accomplished by welding receptacle 22 to upper support piece 14, or by any other method known in the art. As best shown in FIG. 2A, receptacle 22 comprises a box-like structure having the back of upper support piece 14 as one of its walls and being open on at least two of its sides, the remaining sides being closed. Surfaces 60 are substantially perpendicular to upper support piece 14, and surface 62 is substantially parallel to upper support piece 14 such that the receptacle 22 will easily accept a peg therein. In practice, receptacle 22 is positioned over a peg attached to a weight stand (see FIG. 4), thus causing weight support 10 to be maintained in a desired position. In other embodiments, receptacle 22 may comprise an opening in upper support piece 14, a hook-shaped structure attached thereto, or any other mechanism adapted to removably attach weight support 10 to a frame.

A sloping side 38 of weight stand 30 includes pegs 44 on which weight support 10 may rest. Identification numbers, not shown, may be placed, in at least one embodiment of the invention, near each peg 44. These may be used as a memory device for weightlifters using weight stand 30 for various lifting exercises in which weight support 10 is placed at different positions using different pairs of pegs 44. Rather than determining anew the optimal position for a particular lift, a weightlifter may simply memorize the number of the peg 44 that is most comfortable, and place weight support 10 on the corresponding peg 44. In one embodiment of the invention, weight stand 10 is lifted so as to position receptacle 22 above a particular peg 44. Weight stand 10 is then moved in the direction of arrow 45 until receptacle 22 rests on peg 44.

Referring still to FIGS. 2 and 3, a reinforcing extension 25 may be attached to weight support 10, and may comprise a vertical piece 24 and a crosspiece 26 arranged to form a gusset structure as shown in FIG. 2. One of ordinary skill in the art will recognize that other components may be arranged in other configurations to accomplish the same goal of providing structural reinforcement. In this way, among others, the present invention is adapted to support free weights representing up to 300 pounds or more in total weight.

Referring now in particular to FIG. 3, weight stand 30, when configured according to an embodiment of the present invention, comprises side frame members 32 attached to opposite ends of at least one bottom frame member 34 and at least one top frame member 36. Side frame members 32 comprise sloping side 38 and a straight side 40 connected by a plurality of connecting bars 42. FIG. 3 shows three such connecting bars, though more or fewer could also be used. At least one peg 44 is attached to each side frame member 32 along sloping side 38. Pegs 44 are arranged in inwardly extending pairs such that a straight bar with one end resting on one peg 44 and the other end resting on the other peg 44 would be level, meaning it would lie parallel to the surface on which weight stand 30 is placed. In particular, weight support 10 is adapted to rest in this manner on pairs of pegs 44, as shown in FIG. 4. In one embodiment of the invention, seven such pairs of pegs 44 are attached to sloping side 38 of side frame members 32. In one embodiment, each peg 44 is vertically displaced from its closest neighbor by approximately five inches.

The length of the bottommost connecting bar 42 may vary, with the lengths of the other connecting bars 42 changing accordingly. In one embodiment, the bottommost connecting bar 42 is approximately 48 inches long, with the middle connecting bar being approximately 32 inches and the top connecting bar being approximately 25 inches. The height of straight side 40 may be 59 inches. The angle between sloping side 38 and a line perpendicular with the surface on which weight stand 30 rests may be between approximately 15–25 degrees and more particularly around 20 degrees. If the angle is too small, there is a greater likelihood that a weight may fall off of the weight support 10 placed on the weight stand. If the angle is too great, there is a greater likelihood that the weight stand's middle connecting bars 42 will interfere with a weight lifter's arm movement, thereby restricting fill range lifting exercises. Each component of weight stand 30, excluding pegs 44, may comprise three-inch by two-inch by one-eighth-inch rectangular tubing. In at least one embodiment, weight stand 30 may be powder-coated for aesthetic and durability purposes. The dimensions given above describe a possible embodiment of the present invention, but it is emphasized that there are many other dimensions that are also suitable, and the invention is not to be understood as to be limited to any of the illustrative dimensions given above. For example, if the invention is intended for use with weights suited to beginning weightlifters, the components that make up weight stand 30 need not be as durable or as thick as when the invention is intended for use by advanced weightlifters capable of lifting very heavy weights. Thus, the invention may be constructed with various dimensions chosen to suit the various purposes for which it may be used.

Turning now to FIG. 4, weight support 10 is shown supported on weight stand 30 at pegs 44. Dumbbells 50 are placed such that they contact weight stand 10 at impact strips 20. Handles 52 of dumbbells 50 are centered approximately about cutouts 16 so as to be more easily accessible. Side members 32 define an exercise space 56 therebetween, in which a weight bench, not shown, may be placed. A spotter, also not shown, may also occupy exercise space 56 to assist a weightlifter during an exercise session. The spotter may enter exercise space 56 from the front, rear, or either side simply by ducking under or stepping over the various structural components of weight stand 30.

As was first explained in connection with FIG. 2, weight support 10 may be adjusted to any of various positions, or exercise heights, on weight stand 30 by grasping weight support 10, perhaps at carrying slot 18, and lifting it so that receptacles 22 (see FIG. 2) are positioned above the particular pegs 44 that are at a desired height. Weight stand 10 may then be lowered onto pegs 44 such that receptacles 22 settle onto pegs 44 and maintain weight support 10 in the chosen position. Free weights, including dumbbells, may then be placed on weight support 10, and if desired, may be approximately centered about cutouts 16.

The foregoing description has described selected embodiments of a weight stand having a weight support that extends between opposing side frame members of a frame assembly. As has been discussed, the opposing side frame members are provided with a series of pegs adapted to maintain the weight support at various heights. The space between the opposing side frame members is suitable for placement of a weight bench, and also is sufficient to admit a person acting as a spotter. The weight support, in at least one embodiment, includes upper and lower support pieces arranged at an angle to each other so as to form a wedge-shaped area in which dumbbells can securely rest. The configuration of the weight support is such that dumbbells can readily be retrieved and replaced.

While the invention has been particularly shown and described with reference to selected embodiments thereof, it will be readily understood by one of ordinary skill in the art that, as limited only by the appended claims, various changes in form and details may be made therein without departing from the spirit and scope of the invention.

I claim:

1. A weight stand adapted to support at least one free weight at an exercise position selectable by a weightlifter, the weight stand comprising:

a frame assembly, the frame assembly comprising a first side frame member and a second side frame member, each having a plurality of pegs attached thereto, the pegs positioned at various heights on the side frame members, and extending toward each other into an exercise space defined between the side frame members; and a weight support extending between the opposing side frame members through the exercise space, the weight support configured to rest upon at least one peg from each side frame member and receive the at least one free weight, wherein the weight support comprises a lower support piece attached at an angle to an upper support piece, the lower and upper support pieces forming a wedge adapted to receive the at least one free weight.

2. The invention of claim 1, wherein the weight support further comprises at least one of the following:

a carrying slot in the upper support piece;

at least one reinforcing extension attached to the lower support piece;

one or more cutouts in the lower support piece; or a receptacle attached to the upper support piece, the receptacle configured to engage the pegs, thereby maintaining the weight support at the exercise position.

3. The invention of claim 1, wherein the frame assembly further comprises a top frame member and a bottom frame member, the top and bottom frame members attached to and extending between the opposing side frame members.

4. The invention of claim 1, wherein the plurality of pegs comprises at least three pegs attached to the first side frame member and at least three pegs attached to the second side frame member.

5. The invention of claim 4, wherein the plurality of pegs comprises at least seven pegs attached to the first side frame member and at least seven pegs attached to the second side frame member.

6. The invention of claim 1, wherein the weight support includes at least one impact strip adapted to cushion the free weight.

7. A weight support for supporting at least one free weight at selective positions on a weight stand having a plurality of inwardly extending peg sets on side frame members, the weight support comprising:

a lower support piece attached at an angle to an upper support piece, the lower and upper support pieces forming a wedge configured to receive the at least one free weight; and two spaced receptacles attached to the upper support piece, the receptacles each comprising an open box structure to receive a peg on the weight stand on which the weight support may be placed, to maintain the weight support at an exercise position.

8. The invention of claim 7, wherein the weight support comprises one or more of:

a carrying slot in the upper support piece;

at least one reinforcing extension attached to the lower support piece; and one or more cutouts in the lower support piece.

9. A method for positioning at least one free weight on a weight stand at an exercise position, the method comprising the steps of:

selecting a first exercise height at which to place a weight support for the free weight;

placing the weight support on the weight stand at the first exercise height by lowering spaced receptacles attached to the weight support onto a first peg set on the weight stand on opposing sides of an exercise space defined by the weight stand;

placing the free weight on the weight support;

selecting a second exercise height different from the first exercise height;

moving the weight support from the first exercise height to the second exercise height by raising the spaced receptacles from the first peg set, moving the weight support to the second exercise height and lowering the spaced receptacles onto a second peg set on the weight stand on opposing sides of the exercise space; and placing the free weight on the weight support.

10. The method of claim 9, wherein the step of placing the free weight on the weight support comprises the step of substantially centering the free weight with respect to a cutout in the weight support.

11. The method of claim 9, each opposing side of the weight stand comprising a plurality of numbered pegs, wherein the step of selecting the first exercise height comprises comparing an identification number associated with a peg set to a previously identified identification number indicative of a personally-preferred exercise height.

* * * * *